United States Patent [19]

McCurdy et al.

[11] Patent Number: 4,844,290

[45] Date of Patent: Jul. 4, 1989

[54] FLUID DISPENSING APPARATUS

[75] Inventors: Edwin D. McCurdy, Corpus Christi, Tex.; Jerry L. Anderson, 2206 Sunwood, San Antonio, Tex. 78232

[73] Assignee: Jerry L. Anderson, San Antonio, Tex.

[21] Appl. No.: 156,440

[22] Filed: Feb. 16, 1988

Related U.S. Application Data

[63] Continuation-in-part of Ser. No. 140,823, Jan. 4, 1988, abandoned, which is a continuation-in-part of Ser. No. 907,050, Sep. 17, 1986, Pat. No. 4,722,463.

[51] Int. Cl.[4] ..... B67D 5/06

[52] U.S. Cl. ..... 222/185; 222/484

[58] Field of Search ..... 222/173, 184, 185, 538, 222/484; 248/147-148

[56] References Cited

U.S. PATENT DOCUMENTS

| | | | |
|---|---|---|---|
| 1,411,573 | 4/1922 | McGarrahan | 222/538 |
| 2,321,836 | 6/1943 | Marzo | 222/386.5 |
| 2,358,850 | 9/1944 | Chenault | 222/538 X |
| 3,814,293 | 6/1974 | Dares | 222/173 |
| 3,830,406 | 8/1974 | Robb | 222/143 |
| 4,664,297 | 5/1987 | Giovinazzi | 222/185 |
| 4,715,516 | 12/1987 | Salvail | 222/153 |

*Primary Examiner*—Michael S. Huppert

*Attorney, Agent, or Firm*—Thomas E. Sisson

[57] ABSTRACT

Apparatus for dispensing fluids from a bottle comprising a housing having a bore extending through the housing and means for releasably securing the housing to the mouth of a bottle containing a fluid therein. A spool slidably received within the bore is selectively positionable in a first, closed position and second, open position. The spool is provided with an air passageway therethrough and an opening in the side wall, and the housing is provided with an air inlet port for passage of air. The housing is also provided with a fluid inlet port and spout for the passage of fluids therethrough. In the second, open position fluid flows through the inlet port into the bore and out of the spout, and air flows through the air inlet port, opening in the side wall of the spool, and air passageway into the bottle. A support stand having a vertical support member for supporting the bottle at an angle with respect to the horizontal is also provided. The support stand is provided with a tang having a channel therein for receiving a keel on the housing of the fluid dispensing apparatus to prevent movement between the support stand and bottle.

8 Claims, 4 Drawing Sheets

FLUID DISPENSING APPARATUS

BACKGROUND OF THE INENTION

This application is a continuation-in-part of co-pending application Ser. No. 140,823, also entitled "Fluid Dispensing Apparatus", filed on Jan. 4, 1988, now abandoned which is a continuation-in-part of co-pending Ser. No. 907,050, also entitled "Fluid Dispensing Apparatus", filed on Sept. 17, 1986 now U.S. Pat. No. 4,722,463.

The present invention relates to an apparatus for dispensing fluids from a bottle. More particularly, the present invention relates to an apparatus for replacing the resealable cap of a bottle, particularly of the screw-on type, which allows a fluid contained therein to be selectively dispensed from the bottle without removing the apparatus from the bottle as is required to dispense the fluid from a bottle sealed by such a releasable cap, and a stand adapted for supporting the bottle when used with that apparatus.

Since the advent of the plastic bottle for the bottling of carbonated soft drinks, wine coolers, juice drinks, and other refreshing liquids, it is now feasible to market these liquid drinks in much larger amounts than could be sold in glass bottles without the risk of breakage or excessive weight in shipping. The term "bottle" as used herein refers to any container for containing a fluid having an opening of narrow diameter. However, it will be understood by those skilled in the art who have the benefit of this disclosure that the present invention has particular utility for use with bottles containing such liquids.

Two, three, and four-liter plastic and glass bottles having screw tops are now commercially available for the convenience of manufacturers, distributors and consumers. In actual use in the home, however, those soft-drink bottles are sometimes unwieldy and much too heavy for easy storage and serving. A two-liter bottle can barely stand upright on a standard refrigerator door shelf. A three-liter bottle must be placed on a very deep refrigerator shelf to be stored in the refrigerator. A relatively strong adult is required to lift and pour from a three-liter bottle. Small children and older or enfeebled adults simply cannot serve themselves a portion of liquid from a three-liter or larger bottle because of the weight and dimensions of the bottle.

Another problem with such large bottles is that they are commonly used as containers for carbonated beverages. The constant tipping, agitation, opening and closing of the bottle causes the loss of the carbonation. Accordingly, a need has arisen for an apparatus for retaining a large bottle on a refrigerator shelf or other relatively flat surface for dispensing desired amounts of a carbonated beverage or other liquid from the bottle.

It is, therefore, an object of the present invention to provide an apparatus for retaining large bottles thereon, and for dispensing desired amounts of liquid from such a bottle without dissipating the carbonation of the beverage enclosed in the bottle.

It is another object of the present invention to provide a portable dispensing unit having a dispensing apparatus which can be quickly and easily secured to the mouth of a carbonated beverage bottle or other fluid containing bottle, and a support stand within which the bottle can be quickly and conveniently secured.

A further object of the present invention is to provide a dispensing mechanism and support apparatus for plastic beverage bottles which is adaptable for use with any of the commercially available sizes of plastic beverage bottles for storage and serving.

These and other objects, features and advantages of the invention will become apparent to those skilled in the art in light of the following detailed description, viewed in conjunction with the referenced drawings, of a presently preferred beverage dispensing apparatus constructed in accordance with the invention. The foregoing and following description of the invention is for exemplary purposes only.

SUMMARY OF THE INVENTION

An apparatus for dispensing fluids from a bottle comprising a housing having an axially extending bore therethrough and means for releasably closing a bottle containing fluid therein. A cylindrical spool is slidably received within the axially extending bore of the housing and selectively positionable in a first closed position or a second open position, and means is provided for biasing the spool toward the first closed position. The housing is provided with a fluid inlet port through the wall of the portion of the housing contained within the bottle, and the fluid inlet port is continuous with the axially extending bore when the spool is in the second open position. The housing is also provided with a spout through the wall of the portion of the housing outside of the bottle which is continuous with the axially extending bore therethrough. The spool is provided with an air passageway having a first opening at the proximal or first end of the spool and a second opening in the side wall of the distal or second end of the spool. An air inlet port is formed in the axially extending bore through the portion of the housing located outside the bottle, and when the spool is in the second open position, the air passageway, opening in the side wall of the spool, and air inlet port are continuous for passage of air therethrough and the fluid inlet port, axially extending bore, and spout are continuous for passage of fluid therethrough.

Also provided is a support stand for a bottle having a dispensing apparatus mounted thereto for dispensing a beverage contained therein. The support stand comprises a bridge, or base, having an integral vertical support member at one end thereof and means on the vertical support member adapted for engaging a bottle containing a beverage therein. The base is also provided with integral means adapted for engaging the housing of a dispensing apparatus mounted to the mouth of a bottle to prevent movement of a bottle supported thereon relative to the support stand and an integral stop at the other end of the base from the vertical support member for engaging the edge of the surface on which the support stand rests when beverage is being dispensed from a bottle supported thereon to prevent movement of the support stand relative to the surface on which the support stand rests.

Also provided is a method of dispensing a fluid from a bottle to which the above-described fluid dispensing apparatus has been mounted. The method involves supporting the bottle at an angle with respect to the horizontal and preventing movement between the bottle and the support stand and also the support stand and the horizontal surface on which support stand rests while dispensing fluid therefrom.

DETAILED DESCRIPTION OF THE DRAWINGS

Figure 1:
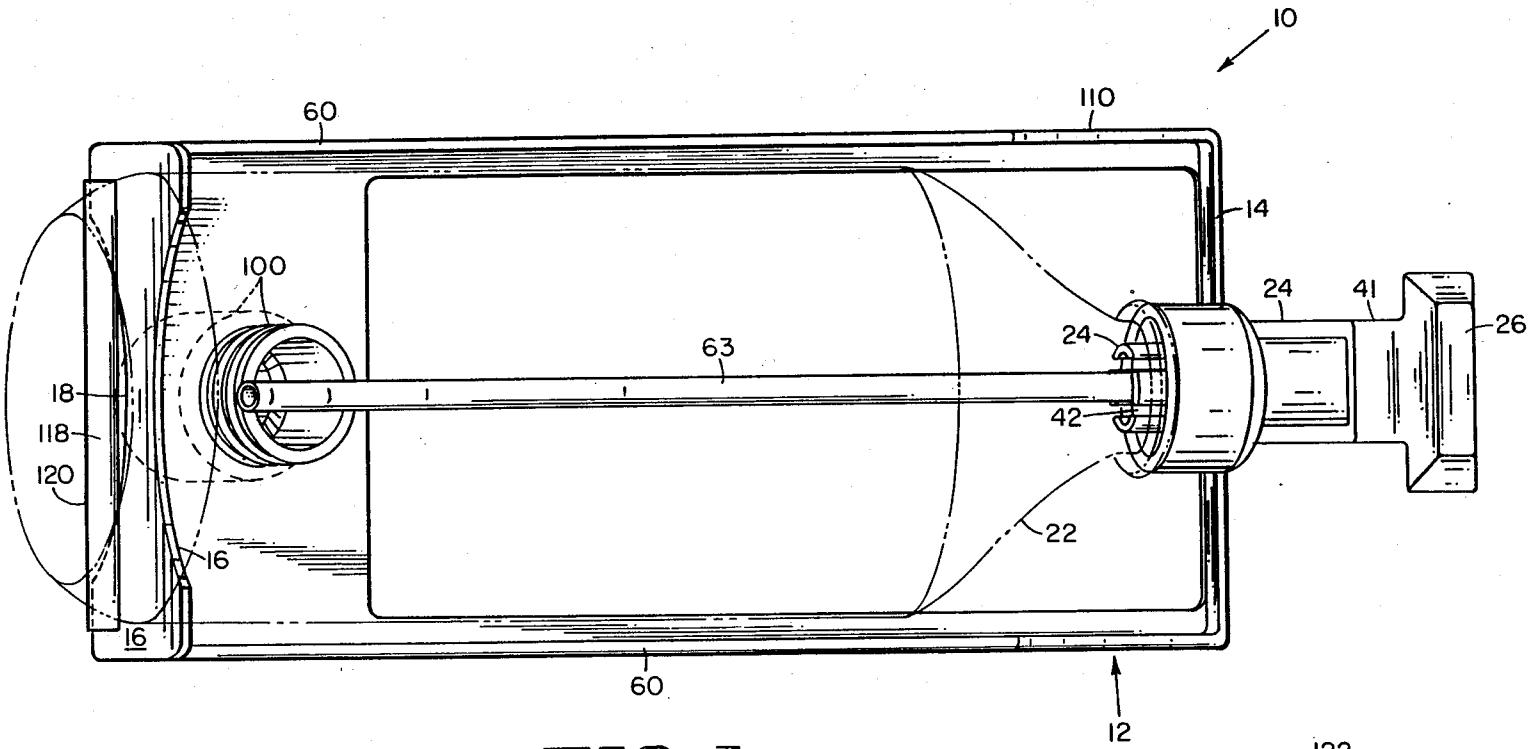
FIG. 1 is a plan view of a beverage dispensing apparatus constructed according to the teachings of the present invention.
Figure 9A:
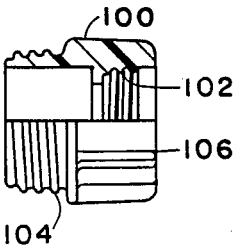
FIG. 9A is a partial longitudinal section of the adapter ring for use with bottles having mouths of different diameters taken along a line in 9A—9A in FIG. 9B.
Figure 9B:
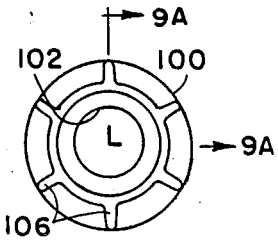
FIG. 9B is a plan view of the adapter ring of FIG. 9A.

A presently preferred embodiment of an apparatus for dispensing fluids constructed according to the present invention is designated generally at reference numeral 10 in FIG. 1. The apparatus 10 for dispensing fluids 21 from a bottle 22 comprises a housing 24 having an axially extending bore 33 therethrough (see FIGS. 3, 4, and 5) and means for releasably closing bottle 22 containing a fluid 21 therein. In a presently preferred embodiment, the means for releasably closing bottle 22 is threads 27 (see FIGS. 3, 4 and 5) integrally formed in housing 24 for screwing the housing 24 onto and off of the screw-top mouth (not numbered) of, for instance, a plastic beverage bottle 22. The housing 24 can also be constructed having a snap-on engagement means (not shown) for use with bottles not having screw-caps. An adapter ring 100 (see FIGS. 5, 9A, and 9B) of the appropriate thickness with screw threads on both inside and outside 102 and 104 surfaces thereof, respectively, can be provided to allow housing 24 to be screwed onto the mouth of two, three, or four liter bottles. The outside surface of adapter ring 100 is also provided with a plurality of raised spokes 106 to facilitate gripping and turning when adapter ring 100 is screwed into the threads 27 of housing 24 or the mouth of bottle 22 as shown in FIG. 5.

Figure 4:
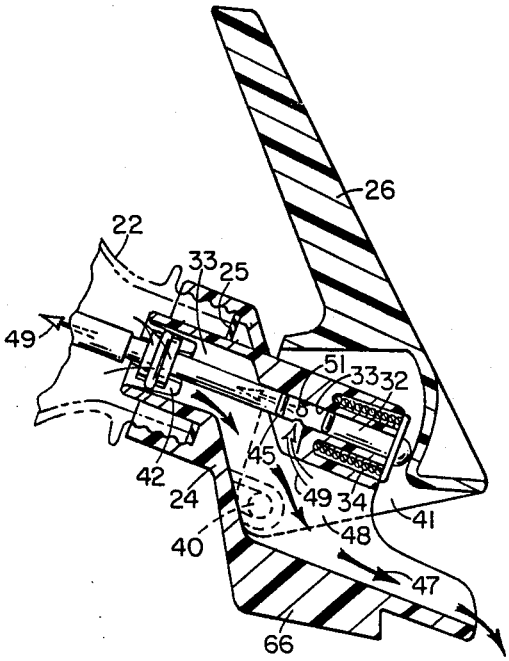
FIG. 4 ,is an enlarged view of a longitudinal section of the apparatus of the present invention taken along a line 3—3 in FIG. 1 when the appratus is in a second open position.
Figure 5:
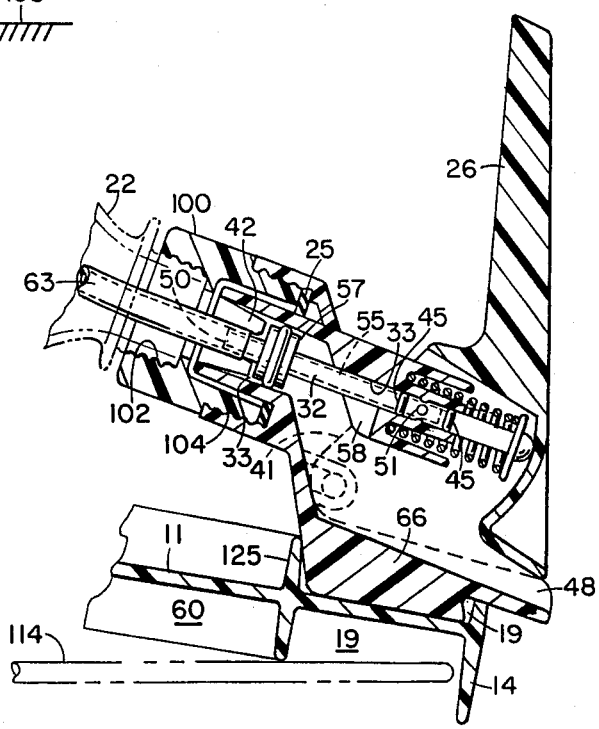
FIG. 5 is an enlarged view of a longitudinal section of the apparatus of the present invention taken along a line 3—3 in FIG. 1 showing the apparatus in use on a resealable bottle when the apparatus is in the first closed position.
Figure 3:
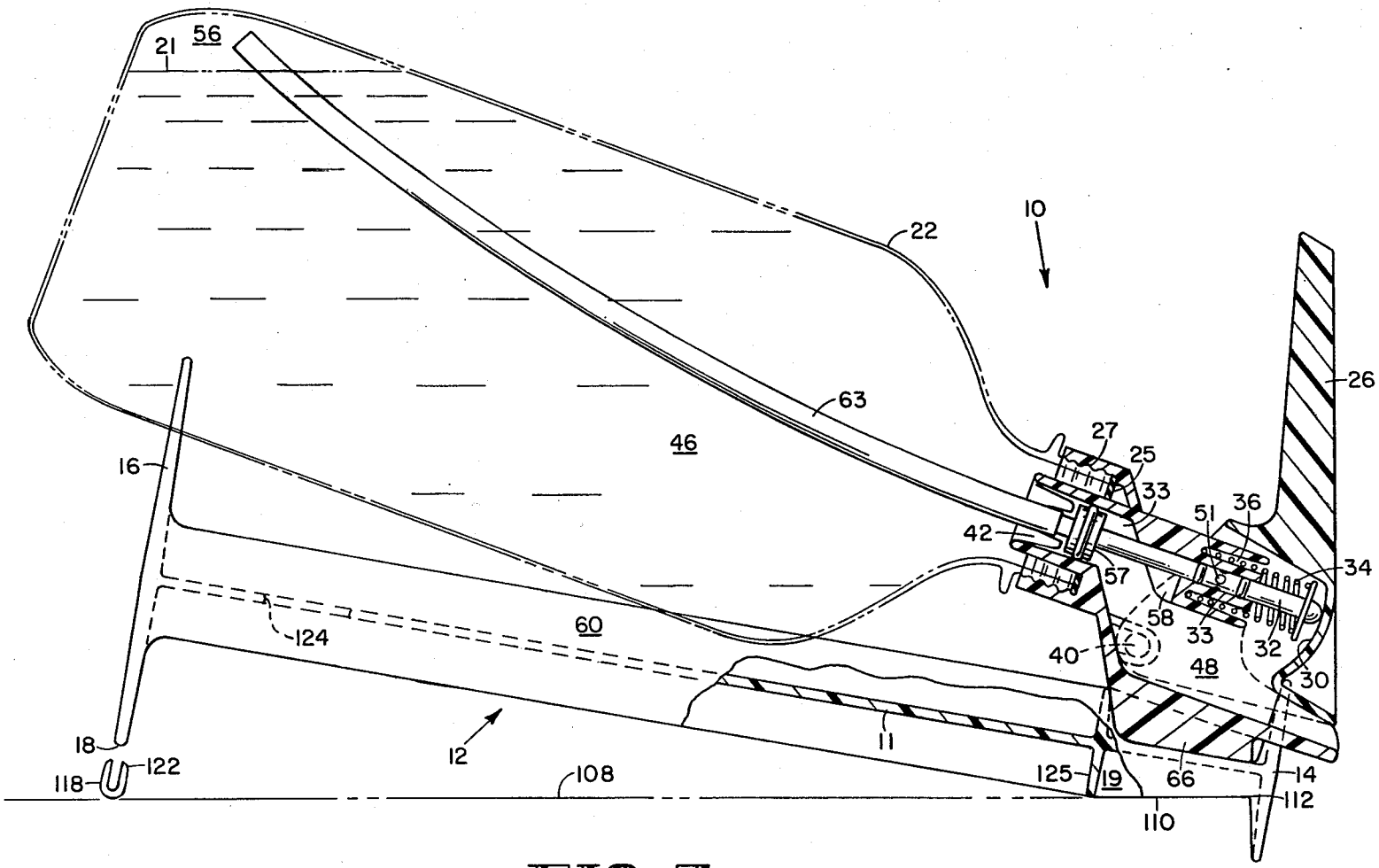
FIG. 3 is a longitudinal section of the apparatus of the present invention, taken along a line 3—3 in FIG. 1, when the apparatus is in a first closed position.

FIGS. 3, 4 and 5 show in longitudinal section the cylindrical spool 32 slidably received within the axially extending bore 33 of housing 24. The spool 32 is selectively positionable in a first, closed position, shown in FIGS. 3 and 5, or a second, open position, shown in FIG. 4. Apparatus 10 is provided with means for biasing spool 32 towards the first, closed position in the form of the weight of fluid 21 contained within bottle 22, the carbonation from carbonated liquids within a bottle 22, and the gravitational force exerted on spool 32. In a presently preferred embodiment, the fluid dispensing apparatus 10 is also provided with a spring 34 for biasing the spool 32 toward the first closed position.

Spring 34 is captured between the bottom of recess 36 in housing 24 and flange 38 of spool 32. Spring 34 concentrically surrounds spool 32, and biases spool 32 toward the first closed position. Fluid inlet ports 42 through the portion of the wall of housing 24 which is contained within bottle 22 when housing 24 releasably engages the mouth of bottle 22 are continuous with axially extending bore 33 when spool 32 is in the second open position shown in FIG. 4. Means is provided on the first end of spool 32 for sealing against the inner wall of axially extending bore 33 in the form of O-ring 51 which is captured between the shoulders 53 of the piston 57 which is integral with spool 32. A spout 48 is continuous with axially extending bore 33 and extends through the wall of housing 24 in that portion of the housing 24 outside of bottle 22.

Spool 32 is provided with an air passageway 55 therethrough, shown in FIG. 5. Air passageway 55 has a first opening 50 at the first end of the spool 32 and a plurality of second openings 51 in the side wall thereof near the distal or second end of spool 32 between the O-rings 45. Openings 51 are spaced at approximately ninety degree intervals around the circumference of spool 32.

Referring to FIGS. 3 and 4, housing 24 is provided with an air inlet port 58 in the axially extending bore 33 in close proximity to spout 48 whereby the air passageway 55, openings 51, and the air inlet port 58 are continuous and the fluid inlet ports 42, axially extending bore 33, and spout 48 are continuous when the spool 32 is in the second open position. Spool 32 can be selectively positioned in the second open position shown in FIG. 4 by the exertion of pressure on spool 32 against the biasing force of spring 34 and the gravitational forces and pressures from within bottle 22. This pressure can be exerted directly, by pushing on the end of spool 32, for instance, on a button mounted thereon (not shown), or by pushing handle 26, which is pivotally mounted to housing 24 on pins 40, forward, i.e., toward bottle 22 (see FIGS. 3 and 4). This pivotal movement causes the surface 30 of the lever arm 26 to act as a bearing surface to exert pressure against the end of spool 32. Sufficient compression of spring 34 permits spool 32 to be selectively positioned in the second, open position as shown in FIG. 4.

In this second, open position, fluid flows from interior fluid space 46 within bottle 22 through fluid inlet ports 42, axially extending bore 33, and spout 48, thus passing from the interior of bottle 22 to the exterior of bottle 22 through housing 24 as shown by arrow 47. At the same time, air flows through air inlet port 58, openings 51, and air passageway 55 to air inlet tube 63 as shown by arrows 49. If viewed in cross section, air inlet port 58 occupies approximately 120° of the circumference of the wall of axially extending bore 33. The width of air inlet port 58 insures that at least portions of two of the openings 51 are aligned therewith, regardless of any rotation of spool 32, to facilitate passage of air from air inlet port 58 into air passageway 55 through openings 51. Means in the form of O-rings 45 is provided to seal against the inner wall of axially extending bore 33 to prevent liquid from escaping through openings 51. Air inlet tube 63 is integral with spool 32 at the first or proximal end thereof, and permits passage of air through air inlet tube 63 to the interior air space 56 of bottle 22.

In a presently preferred embodiment of the invention, the air inlet tube 63 is constructed of light, flexible tubing. Air inlet tube 63 can be provided with a float (not shown) which allows the end of air inlet tube 63 to float to the surface of the fluid 21 within plastic beverage bottle 22.

Figure 2:
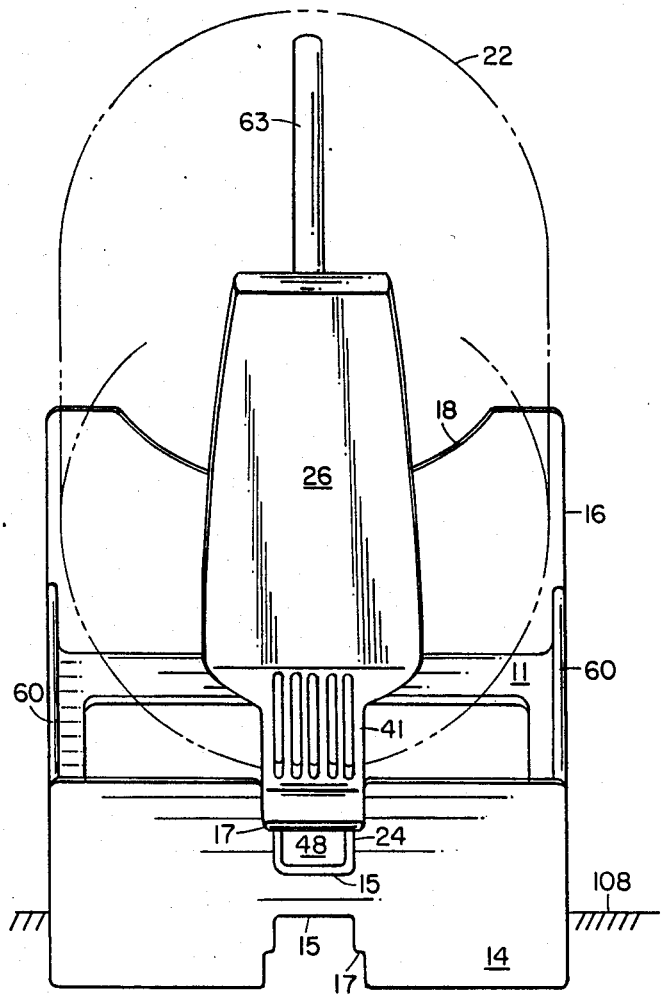
FIG. 2 is a front view of the apparatus of the present invention.

Referring to FIGS. 1, 2, and 3, bottle 22 is shown supported on support stand 12. In a presently preferred embodiment, support stand 12 is constructed of molded plastic, and each end of the vertical support member 16 of support stand 12 has a semicircular curved recess 18 with a radius of curvature molded therein adapted for engaging the outside surface of a bottle 22 of different volume thereon. For instance, a two liter bottle can be supported on one end of vertical support member 16 and support stand 12 then turned over to support a three liter bottle with the recess 18 of the other end of vertical support member 16.

Figure 6:
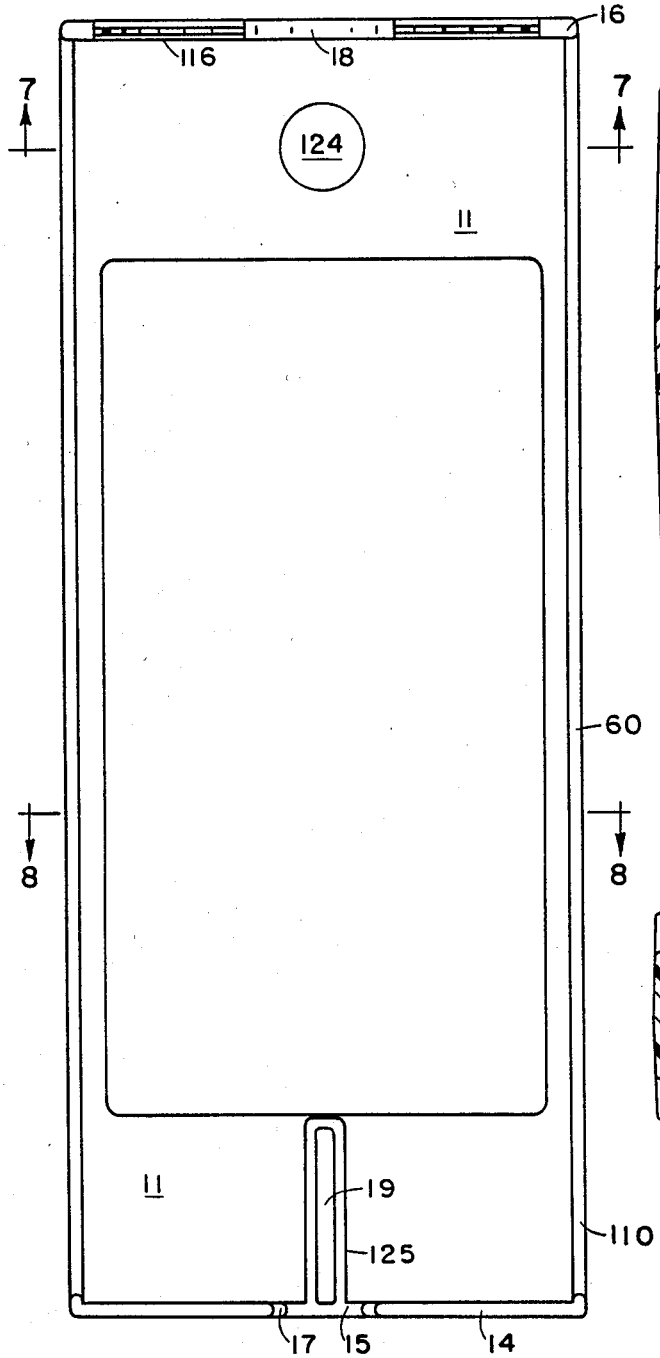
FIG. 6 is a plan view of the support stand for the apparatus of the present invention with the bottle containing a fluid to be dispensed and the adapter ring for use with bottles having mouths of different diameters removed therefrom.
Figure 7:
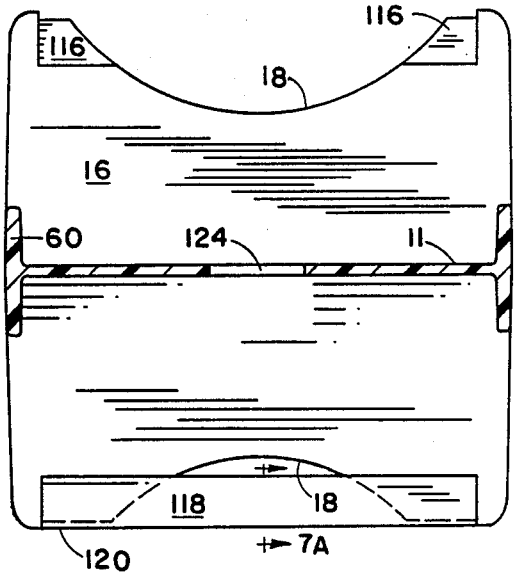
FIG. 7 is a cross-sectional view of the support stand of FIG. 6 taken along line 7—7 in FIG.6.
Figure 8:
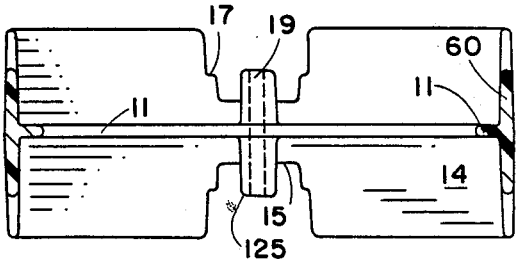
FIG. 8 is a cross-sectional view of the support stand of FIG. 6 taken along line 8—8 in FIG. 6.

Support stand 12 also has a stop 14 extending vertically at an angle from horizontal bridge 11. The bridge, or base, 11 of support stand 12 is provided with longitudinal thickenings, or side rails, 60 to provide rigidity (see FIGS. 6–8). Stop 14 does not extend vertically as far as vertical support member 16 so that when a bottle onto which dispensing apparatus 10 has been mounted is supported upon support stand 12, housing 24 rests securely on the groove 15 of stop 14 and bottle 22 is tilted downwardly to facilitate fluid flow. Groove 15 is provided with shoulders 17 to provide adequate clearance for the sides 41 of handle 26 which extend down along housing 24 to pins 40.

However, in a presently preferred embodiment support stand 12 is best used to advantage by placing one side of vertical support member 16 on a surface 108 (see FIGS. 2 and 3) and resting the tapered portion 110 of the side rails 60 near stop 14 of bridge 11 flat on surface 108 such that one end of stop 14 extends downwardly beyond the corner 112 of surface 108 to prevent movement of support stand 12 relative to surface 108 when handle 26 is pushed toward bottle 22 to dispense fluid therefrom. In a preferred embodiment of the present invention, the tapered portion 110 of side rails 60 is tapered at an angle of approximately 20° relative to bridge 11, and the vertical dimension of vertical support member 16 is sized to allow the tapered portion 110 to lie flat on surface 108.

Figure 7A:
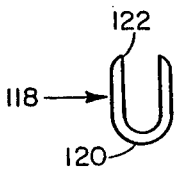
FIG. 7A is a cross-sectional view of the stabilizer for the support stand of FIG. 6 taken along the line 7A—7A in FIG. 7.

Because support stand 12, supporting a bottle 22 thereon, will often be kept on a refrigerator shelf 114 (see FIG. 5) and most refrigerator shelves are of a wire rack-type configuration, vertical support member 16 is provided with rounded detents 116 (see FIG. 7) at the margins of both recesses 18 to provide a positive snap fit for a resilient stabilizer 118 (see FIG. 7A; shown in shadow lines in FIG. 7) which provides a flat edge 120 to lie across the wires of such a refrigerator shelf. Stabilizer 118 is preferably molded of plastic and, as shown in FIG. 7A, is U-shaped in cross section so that the legs 122 thereof firmly engage the detents 116 in vertical support member 16.

The bridge 11 of support stand 12 is also provided with means adapted for engaging the housing 24 of dispensing apparatus 10 mounted to the mouth of bottle 22 supported thereon to prevent movement of bottle 22 relative to support stand 12. In a presently preferred embodiment, that movement prevention means takes the following form. Housing 24 is provided with a keel 66 which engages the channel 19 in the integral tang 125 of bridge 11 (see FIGS. 3, 5, 6, and 8) to prevent movement of bottle 22 relative to the support stand 12. Keel 66 engages the walls of channel 19 to prevent both rotational and longitudinal movement of bottle 22 relative to support stand 12.

To use the apparatus constructed in accordance with the present invention, housing 24 is first threaded about the mouth of bottle 22 using the above-described adapter ring 100, if necessary. When adapter ring 100 is not used in this manner, the adapter ring 100 is stored on support stand 12 by screwing into the hole 124 in the bridge 11. Hole 124 is provided with approximately a three quarter thread (not numbered) to facilitate insertion of adapter ring 100 from either side of bridge 11. Gasket 25 seals housing 24 tightly in connection with the mouth of bottle 22. Bottle 22 is then placed upon support stand 12 to rest within the appropriately-sized recess 18 of vertical support member 16. Keel 66 of housing 24 engages the channel 19 in the tang 125 of bridge 11 of support stand 12 so that bottle 22 will not shift within support stand 12 and the corners of housing are secured firmly within groove 15.

The apparatus 10 of the present invention can be stored on a refrigerator shelf or placed on a countertop or picnic table for serving. Bottle 22 can also be cooled using ice or a chemical ice sleeve (not shown) if desired.

To dispense fluid or beverage from bottle 22, a cup (not shown) is held below the interior of dispensing spout 48. Handle 26 is pushed forward, i.e., toward bottle 22, compressing spring 34 sufficiently to effect the connection of interior fluid space 46 with spout 48 through fluid inlet port 42 and axially extending bore 33. As the fluid or beverage 21 flows out of bottle 22 and through spout 48, air is drawn into air space 56 of bottle 22 through air inlet port 58, second opening 51, air Passageway 55, first opening 50 and air inlet tube 63 at the same time. Simultaneous opening of both fluid and air passageways equalizes internal and external air pressure so that the beverage 21 flows freely out of bottle 22. In the case of a plastic bottle, equalization of interior and exterior pressures prevents the walls of bottle 22 from collapsing.

Although the invention has been described in conjunction with the foregoing specific embodiment, other alternatives, variations, and modifications will be apparent to those of ordinary skill in the art. For instance, it will be understood that when the word "beverage" is used herein, that word is being used in a broader sense than simply referring to something drinkable. In particular, that word can be considered a reference to any fluid supplied in bottles and for which there is a need to dispense a small portion from time to time. Such alternatives, variations, and modifications are intended to fall within the spirit and scope of the appended claims.

What is claimed is:

1. A support stand for a bottle having a fluid dispensing apparatus mounted thereto for dispensing a fluid contained there in comprising:

a base;

an integral vertical support member at one end of said base;

means on said vertical support member adapted for engaging said bottle containing said fluid therein;

means integral with said base adapted for engaging said fluid dispensing apparatus mounted to the mouth of said bottle to prevent movement of said bottle relative to said base; and an integral stop for engaging the edge of the surface on which said vertical support member rests when said fluid is being dispensed from said bottle supported thereon to prevent movement of said support stand relative to said surface on which said vertical support member rests; wherein said base is provided with integral side rails, wherein said side rails are tapered in the position of said base near said stop for supporting said base on said vertical support member and on said tapered portion of said side rails at an angle with respect to said surface on which said support stand rests to facilitate said dispensing of said fluid from said bottle supported thereon.

2. The support stand of claim 1 wherein said stop is integral with said base at an end of said base opposite said vertical support member and extends over an edge of said surface on which said support stand rests when said support stand is supported by said support member and said tapered portion of said side walls.

3. The support stand of claim 1 wherein said means integral with said base adapted for engaging said fluid dispensing apparatus further comprises a tang having a channel therein adapted for receiving a keel of said fluid dispensing apparatus mounted to said mouth of said bottle to be supported on said support stand.

4. The support stand of claim 1 further comprising means on said base adapted for storing an adapter ring usable to adapted the mouths of different size bottles to said fluid dispensing apparatus.

5. The support stand of claim 1 wherein said bottle engaging means further comprises a recess in said vertical support member having a radius of curvature adapted for engaging the outside surface of said bottle to be supported on said support stand.

6. The support stand of claim 1 wherein said vertical support member is provided with first and second recesses, said first recess at one end of said vertical support member having a radius of curvature adapted for engaging the outside surface of a bottle having a first volume and said second recess at the other end of said vertical support member having a radius of curvature adapted for engaging the outside surface of a bottle having a second volume.

7. The support stand of claim 1 further comprising stablizing means detachably mounted to an end of vertical support member to provide a flat end to said vertical support member.

8. The support stand of claim 1 wherein said stop is with a groove adapted for engaging a housing of said fluid dispensing apparatus mounted to said mouth of said bottle.

* * * * *